United States Patent [19]

Inaba

[11] Patent Number: 5,039,012

[45] Date of Patent: Aug. 13, 1991

[54] STRAW FOR BEVERAGES

[76] Inventor: Koichi Inaba, 1994 Denpo Takishita, Fuji-shi, Shizuoka-ken, Japan

[21] Appl. No.: 441,538

[22] Filed: Nov. 27, 1989

[30] Foreign Application Priority Data

Jan. 7, 1988 [JP] Japan ..... 1-105563

[51] Int. Cl.[5] ..... A47G 21/18

[52] U.S. Cl. ..... 239/33; 215/1 A; 229/103.1

[58] Field of Search ..... 239/33, 272, 309; 215/1 A; 206/603; 220/90.2; 229/103.1

[56] References Cited

U.S. PATENT DOCUMENTS

| | | | |
|---|---|---|---|
| 754,948 | 3/1904 | White | 239/33 |
| 1,494,742 | 5/1924 | Hills | 239/33 |
| 2,436,505 | 2/1948 | Durall | 239/33 |
| 2,617,559 | 11/1952 | Van Der Spek | 215/1 A |
| 2,815,981 | 12/1957 | Nonnamaker et al. | 239/33 |
| 3,545,604 | 12/1970 | Gunther, Jr. | 215/1 A |
| 3,554,450 | 1/1971 | D'Muhala | 239/309 |
| 3,780,944 | 12/1973 | Zubalik | 229/103.1 |
| 4,379,511 | 4/1983 | Del Fabro | 215/1 A |
| 4,657,182 | 4/1987 | Hoshi | 239/33 |
| 4,688,721 | 8/1987 | Inaba | 239/33 |
| 4,726,518 | 2/1988 | Martina | 239/33 |
| 4,736,887 | 4/1988 | Inaba | 239/33 |

FOREIGN PATENT DOCUMENTS

| | | | |
|---|---|---|---|
| 341657 | 11/1989 | European Pat. Off. | 239/33 |

*Primary Examiner*—Andres Kashnikow
*Assistant Examiner*—Michael J. Forman
*Attorney, Agent, or Firm*—Price, Heneveld, Cooper, DeWitt & Litton

[57] ABSTRACT

A straw for drinking liquids from an initially sealed container is provided with a pointed end for piercing an opening in the container. The straw is provided with a cross-sectional configuration which creates an unobstructed air passage into the container even when the opening formed by the straw is of no larger diameter than the end of the straw which is used to pierce the container. The straw may have an enlarged piercing head or recessed flutes extending longitudinally to assure creation and maintenance of the air passage.

9 Claims, 3 Drawing Sheets

STRAW FOR BEVERAGES

FIELD OF THE INVENTION

The present invention relates to a straw for use in the consumption of beverages, which straw is adapted to be inserted into the sealed container for the liquid beverage, enabling the user to drink from the container.

BACKGROUND OF THE INVENTION

Straws of uniform diameter adapted to be inserted into a sealed container for liquid beverages to enable the user to drink from the container are well-known. The known straws that have been commonly used are often cylindrical and of uniform diameter throughout their length including both the front end serving as a piercing means to the basal end serving as a mouthpiece. A straw having such a uniform diameter is usually attached to the container's outer side diagonally thereof after the straw has been put into the associated package.

When such a uniform diameter straw pierces the container, a circular hole is created through the wall of the container corresponding in diameter to that of the straw. This leaves no gap between the peripheral edge of said hole and the outer surface of said the, so that insufficient ventilation occurs between the interior and the exterior of the container to facilitate smooth drinking from the container.

Another inconvenience of such uniform diameter straws, particularly those designed to be attached to the container's outer side, is that their length is so limited that the straw could be lost into the container during drinking, if the user carelessly lets it fall into the container.

To overcome the first-mentioned inconvenience, it has been proposed to form the intermediate portion of the straw with at least one groove extending longitudinally of the straw to provide the desired ventilation between the interior and the exterior of the container.

Also, to eliminate the last-mentioned inconvenience, it is also known to provide the basal end of the straw serving as the mouthpiece with a stopper adapted to prevent the straw from falling into the container.

Of these well-known straws which are claimed to be improved as above mentioned, the first-mentioned one provided with at least one groove is, theoretically, certainly advantageous because a gap should be provided by said groove between the straw and the hole through which the straw is inserted into the container and the gap should assure the desired ventilation between the interior and the exterior of the container. However, it has been found from practical use of such straws that the straw readily adapts itself to said hole formed through the container wall due to the properties of the synthetic resin from which the straw is made and, as a consequence, makes it difficult to establish the desired ventilation.

The last-mentioned straw construction provided with the stopper around the basal end of the straw serving as the mouthpiece to prevent the straw from falling into the container is still inconvenient. Not only is it inconvenient in that it does not necessarily assure the ventilation but also because the diameter of the basal end serving as the mouthpiece is considerably larger than the diameter of the front end serving as the piercing means preventing a plurality of such straws from being packaged in parallel relationship to each other during a packaging process conducted in an automatic packaging machine or the like. Thus, automation of the packaging operation has encountered a serious problem since the smooth feeding or movement of these straws essential to automation cannot be assured.

In view of these problems which have been encountered in the use of prior art straws, a first objective of the present invention is to assure that, after a sealed container for liquid beverages has been pierced by the front end of the straw, there is reliably created between the edge of the hole formed as a result of said piercing and the outer surface of the straw extending through the hole a sufficient gap to establish the necessary ventilation between the interior and the exterior of the container. A second objective of the present invention is to provide a novel straw so configured that a plurality of them can be smoothly fed into and passed through an automatic packaging machine or the like to package them in a close-pack parallel arrangement.

BRIEF DESCRIPTION OF THE INVENTION

The objects as set forth above are achieved according to the present invention by a straw for beverages comprising a substantially cylindrical piece made of synthetic resin including an obliquely pointed front end serving as piercing means, a basal end serving as a mouth piece and an intermediate main body, wherein both said front and basal ends have respective diameters larger than that of said intermediate main body, and further, wherein the diameter of said basal end is larger than that of said front end. The present invention also includes a construction such that said intermediate main body has an oval cross-section, the minor diameter of which is smaller than the diameter of the front end serving as the piercing means.

Preferably, said intermediate main body is formed with at least one groove extending longitudinally thereof.

It is preferred to provide said intermediate main body with a plurality of said grooves arranged at substantially regular intervals circumferentially.

To achieve the objects as set forth above, the present invention provides also a straw for beverages comprising a substantially cylindrical piece made of synthetic resin including an obliquely pointed front end serving as piercing means, a basal end serving as a mouthpiece and an intermediate main body, wherein said front end has the same diameter as that of said intermediate main body and said basal end has a diameter larger than that of said intermediate main body. The intermediate main body of the straw is formed with at least one groove extending longitudinally thereof and the synthetic resin has a hardness sufficient to protect said intermediate main body from deformation. Preferably, the intermediate main body is provided with a plurality of the grooves arranged substantially at regular intervals circumferentially.

With the straw for beverages constructed in accordance with the present invention, it is assured that between the edge defining the hole in the container formed by the piercing means at the straw's front end and the outer surface of the straw's intermediate main body there is provided a gap which can be relied upon to establish ventilation between the interior and the exterior of the container, because the cross section of the intermediate main body is smaller than that of the opening formed by the straw's front end serving as the piercing means. Furthermore, there is no fear that the straw might fall into the container due to carelessness of the user, since the basal end serving as the mouthpiece has a diameter larger than that of the hole created by the piercing means. Therefore, the edge defining the hole formed through the container serves as a stop adapted to prevent the straw from sliding entirely into the container.

With the embodiment of the invention so configured that the front end serving as the piercing means has the same diameter of the intermediate main body, use of synthetic resin having a relatively high hardness as material of the straw is effective to prevent deformation of the intermediate main body, on the one hand, and to assure the formation of a gap between the edge defining the hole formed through the container and the outer surface of the intermediate main body, which is essential to provide ventilation between the interior and the exterior of the container.

DESCRIPTION OF THE PREFERRED EMBODIMENT

The present invention will be described by way of example with reference to the accompanying drawings.

Figure 1:
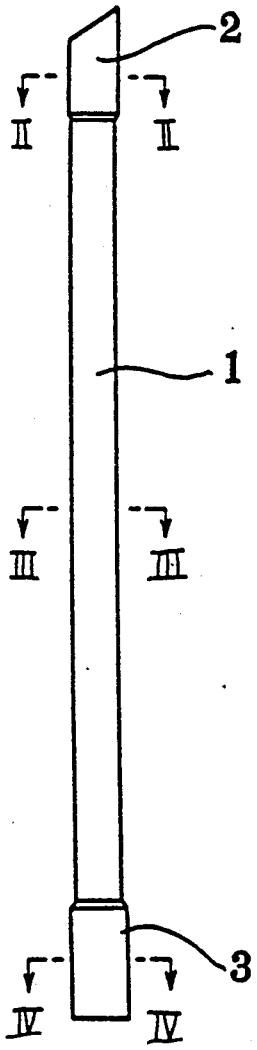
FIG. 1 illustrates a straw embodying the invention.
Figure 2:
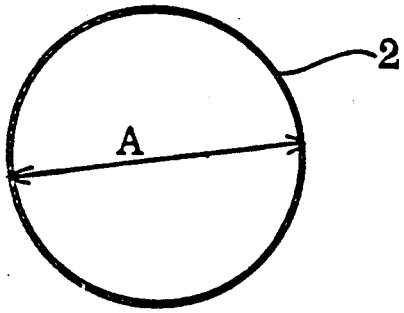
FIG. 2 is an enlarged, sectional view taken along the plane II—II of FIG. 1.
Figure 3:
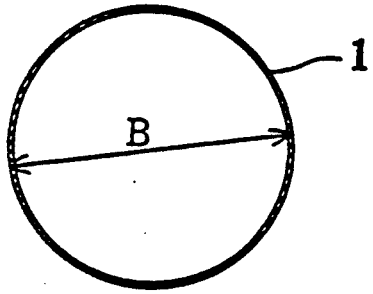
FIG. 3 is an enlarged, sectional view taken along the plane III—III of FIG. 1.
Figure 4:
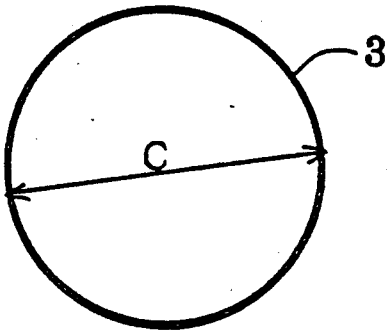
FIG. 4 is an enlarged, sectional view taken along the plane IV—IV of FIG. 1.
Figure 5:
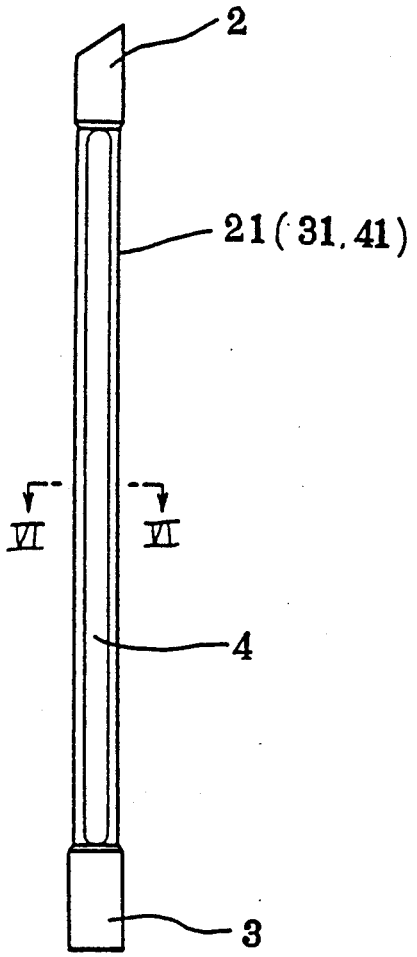
FIG. 5 is a front view of another embodiment which is formed along the intermediate main body with one or more grooves.

The straw shown in FIG. 1 is substantially cylindrical as straws of the prior art have been and comprises a front end serving as a piercing means and a basal end serving as a mouthpiece, both having respective diameters larger than the diameter of the intermediate main body. Referring to FIG. 1, reference numeral 1 designates the intermediate main body having a smaller diameter B. Numeral 2 designates the front end serving as the piercing means and having a diameter A slightly larger than the diameter B of said intermediate main body 1. Numeral 3 designates the basal end, serving as the mouthpiece and having a diameter C slightly larger than diameter A of the front end 2. It should be noted here that, in the specific embodiment as shown by FIG. 1, the outer diameter A of the front end 2 is 4.9 mm, the outer diameter B of the intermediate main body 1 is 4.7 mm and the outer diameter C of the basal end 3 is 5.3 mm.

Figure 6:
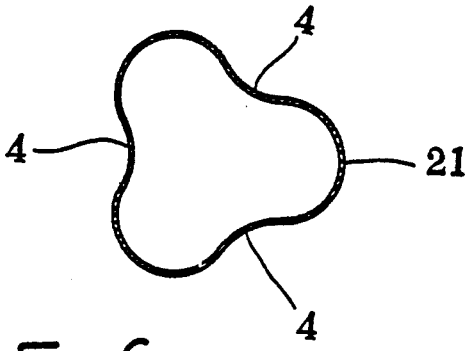
FIG. 6 is an enlarged, sectional view of the intermediate main body formed with three grooves taken along a line VI—VI in FIG. 5.
Figure 7:
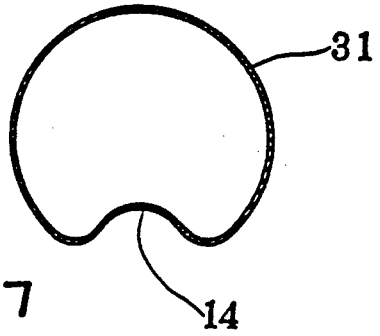
FIG. 7 is a view similar to FIG. 6 but showing the intermediate main body formed with a single groove.
Figure 8:
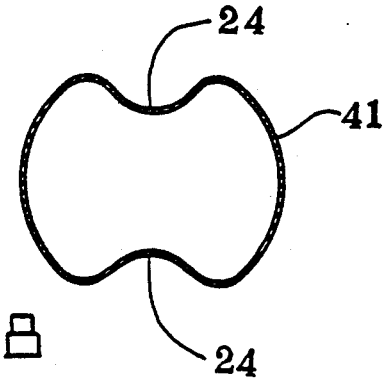
FIG. 8 is a view similar to FIG. 6 but showing the intermediate main body formed with a pair of grooves.

Embodiments shown by FIGS. 5 through 8 and FIGS. 10 and 11 are each formed with the same reduced diameter intermediate main body 1 with one or more grooves 4 extending longitudinally thereof. In the embodiment of FIG. 6, the intermediate main body 21 is formed with three such grooves 4 at equally spaced circumferential intervals. In the embodiment of FIG. 7, the intermediate main body 31 is formed with a single such groove 14. In the embodiment of FIG. 8, the intermediate main body 41 is formed with a pair of such grooves 24. The embodiment of FIG. 10 has five such grooves 44 formed along the intermediate main body 61 and the embodiment of FIG. 11 has four such grooves 54 formed along the intermediate main body 71.

Each of these grooves 4, 14, 24, 44 and 54 functions to assure a gap between the edge defining the hole formed by the front end of the straw extending into the container and the outer surface of the intermediate main body of the straw to provide positive ventilation between the interior and the exterior of the container.

As will be apparent from FIGS. 7 and 8, the intermediate main body exhibits an approximately oval cross section when said intermediate main body 31 or 41 is formed with a single groove 14 or a pair of grooves 24, respectively and, therefore, there is a fear that a case containing the individual straw might often fail to be properly secured by the applicator used to secure the case to the container's side wall. In this regard, the embodiment of FIG. 6 having three grooves 4 and the embodiment of FIG. 10 having five grooves 44 are preferred for practical use, since said possibility of improper attachment is effectively reduced by increasing the number of said grooves.

Figure 9:
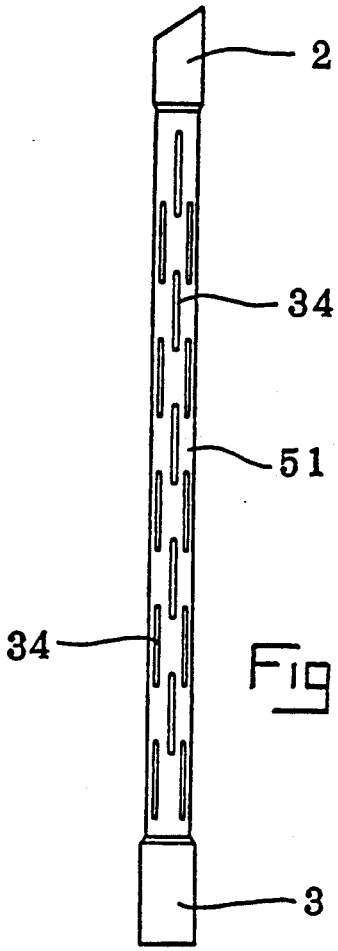
FIG. 9 is a front view showing still another embodiment of the straw constructed according to the present invention.
Figure 10:
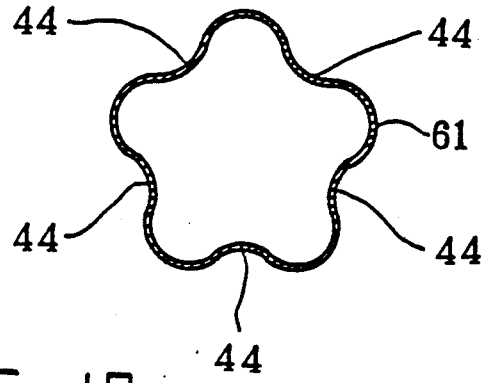
FIG. 10 is an enlarged, sectional view of the intermediate main body formed with five grooves.
Figure 11:
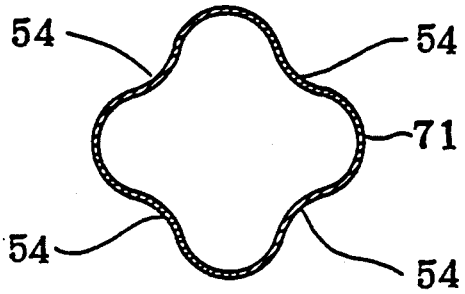
FIG. 11 is a view similar to FIG. 10 but showing the intermediate main body formed with four grooves.
Figure 12:
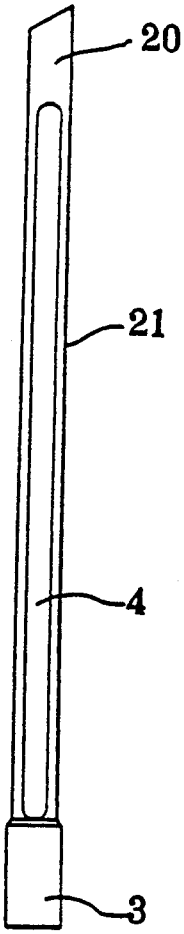
FIG. 12 is a front view showing a further embodiment of the present invention.

FIG. 9 shows an embodiment of the straw having a plurality of discontinuous short grooves 34 extending longitudinally of the intermediate main body 51 and distributed circumferentially. FIG. 12 shows another embodiment of the straw constructed in accordance with the present invention, in which the front end 20, serving as the piercing means, has the same diameter as that of the intermediate main body 21 but the basal end 3 serving as the mouthpiece has a diameter larger than that of the intermediate main body 21 which main body is, in turn, formed with one or more grooves 4 extending longitudinally thereof. In this specific embodiment, the straw as a whole, is made of synthetic resin providing a sufficient hardness to protect the straw from deformation and thereby to assure the desired gap between the outer surface of the straw's intermediate main body and the edge defining the hole formed through the container's wall created by insertion of the straw through the container's wall.

As has been described hereinabove, in one species of this invention, the diameter of the front end serving as the piercing means is larger than the diameter of the intermediate main body and the diameter of the basal end, serving as the mouthpiece, is slightly larger than the diameter of said front end serving as the piercing means. Such feature advantageously results in the formation of a hole through the container's wall larger than the cross section of the straw's intermediate main body produced by the insertion of the straw's front end through said container's wall. This leaves a sufficient gap to assure the desired ventilation and thereby to facilitate drinking from the container. One or more grooves formed along the intermediate main body assures a further improvement in ventilation. In addition, the diameter of the basal end serving as the mouthpiece is dimensioned larger than the diameter of said front end serving as the piercing means and, as a consequence, the straw is prevented from falling into the container.

It should be noted here that the difference between the diameters of the basal end and that of the front end is not significant. Such configuration of the individual straws allows a plurality of straws to be smoothly fed into an automatic packaging machine or the like to package them in an orderly, aligned arrangement and avoid the undesirable tendency of the straws to become misaligned from the desired aligned parallel arrangement.

Formation of one or more grooves longitudinally along the intermediate main body is effective to assure said ventilation and particularly formation of three grooves distributed at regular intervals in the circumferential direction is very effective in practical use, avoiding the possibility that the individual straws might fail to be properly attached by the applicator.

Finally, when the invention is embodied so that the front end serving as the piercing means has the same diameter as that of the intermediate main body, synthetic resin having an adequate hardness may be selected as the material for the straw to avoid deformation of the intermediate main body and thereby to maintain the desired ventilation. The first object of the present invention is achieved by this embodiment.

I claim:

1. A one piece unitary straw for beverages comprising a cylindrical body of synthetic resin having one end shaped to provide an obliquely pointed piercing means, the other end portion thereof serving as a mouthpiece, said ends being integral with and joined by an intermediate main body portion, the diameter of said one end portion being greater than that of said intermediate main body portion, and the diameter of said other end being larger than that of said one end and of said main body portion whereby it will not pass through the opening formed by the piercing means.

2. A one piece unitary straw for beverages as described in claim 1 wherein the diameter of said straw between said enlarged ends is uniform.

3. A one piece unitary straw for beverages as described in claim 2 wherein said intermediate body portion has a groove extending lengthwise thereof.

4. A one piece unitary straw for beverages as described in claim 2 wherein said main body portion has a plurality of parallel grooves extending lengthwise thereof.

5. A one piece unitary straw for beverages as described in claim 4 wherein said grooves are each formed as a plurality of aligned segments, each segment being substantially shorter than the length of said main body portion, the segments of one groove being offset axially of the straw from the segments of the grooves on either side of it.

6. A one piece unitary straw for beverages as described in claim 1 wherein said main body portion has a groove extending lengthwise thereof.

7. A one piece unitary straw for beverages as described in claim 1 wherein said main body portion has a plurality of parallel external grooves extending lengthwise thereof.

8. A one piece unitary straw for beverages as described in claim 1 wherein said main body portion has a plurality of parallel grooves extending lengthwise thereof.

9. A one piece unitary straw for withdrawal of beverage from a container, said straw being of fixed length and having a cylindrical body of synthetic resin, said body having a pair of enlarged ends integrally joined by a central portion, one end portion thereof serving as a beverage container piercing means and the other as a mouthpiece, said other end having a diameter greater than that of the one end of said cylindrical body whereby it will not pass through the opening formed in the container by the piercing means.

* * * * *